US005357715A

United States Patent [19]

Hiramatsu

[11] Patent Number: 5,357,715

[45] Date of Patent: Oct. 25, 1994

[54] SANDER

[75] Inventor: Shinichi Hiramatsu, Anjo, Japan

[73] Assignee: Makita Corporation, Anjo, Japan

[21] Appl. No.: 70,846

[22] Filed: Jun. 3, 1993

[30] Foreign Application Priority Data

Jun. 8, 1992 [JP] Japan ..... 4-174870

[51] Int. Cl.[5] ..... B24B 23/00

[52] U.S. Cl. ..... 451/357

[58] Field of Search ..... 51/170 R, 170 MT

[56] References Cited

U.S. PATENT DOCUMENTS 4,727,682 3/1988 Stabler et al. .
4,759,152 7/1988 Berger et al. .
5,018,314 5/1991 Fushiya et al. ..... 51/170 MT
5,167,095 12/1992 Berger et al. ..... 51/170 MT
5,170,588 12/1992 Schaal et al. ..... 51/170 MT

FOREIGN PATENT DOCUMENTS 0320599 6/1989 European Pat. Off. .
3625535 2/1988 Fed. Rep. of Germany .... 51/170 R
4012774 10/1991 Fed. Rep. of Germany .

*Primary Examiner*—Roscoe V. Parker
*Attorney, Agent, or Firm*—Dennison, Meserole, Pollack & Scheiner

[57] ABSTRACT

A sander includes a body and a drive device mounted on the body. A spindle is rotatably driven by the drive device. A connecting shaft is mounted on the spindle and is rotatable relative to the spindle around an axis displaced from the rotational axis of the spindle. An abrasive disc is fixedly mounted on the connecting shaft. A sun gear is fixedly mounted on the connecting shaft coaxially therewith. An internal gear is rotatably supported by the body and is in engagement with the sun gear. An engaging device is operable to prevent and permit rotation of the internal gear relative to the body.

8 Claims, 4 Drawing Sheets

SANDER

BACKGROUND OF THE INVENTION

1. Field of the Invention

The present invention relates to a sander, and more particularly to a sander having an abrasive disc which performs a dual motion including a revolving motion around its axis and an eccentric rotational motion or an orbital motion.

2. Description of the Prior Art

A conventional sander includes a motor disposed within a body, a spindle rotatably driven by the motor, a connecting shaft rotatably mounted on the spindle and having a rotational axis displaced from the axis of the spindle, and an abrasive disc fixedly mounted on the connecting shaft. A sun gear is fixed to the connecting shaft coaxially therewith. An internal gear is fixed to the body and is in engagement with the sun gear. The number of teeth of the internal gear is greater than that of the sun gear. With such a conventional sander, the abrasive disc may perform a dual motion including a revolving motion around the connecting shaft and an orbital motion or an eccentric rotational motion around the spindle.

Here, the rotation of the spindle is reduced by the sun gear and the internal gear and is transmitted to the connecting shaft of the abrasive disc. Since the abrasive disc is forcibly rotated through engagement of the sun gear with the internal gear, the abrasive disc has a larger momentum. Therefore, the amount of abrasion of a work tends to become greater, and the sander cannot be used to abrade a work made of soft material. Further, the sander involves a disadvantage that it cannot be used for finishing abrasion.

In order to solve this problem, U.S. Pat. No. 4,727,682 proposes a grinder having an internal gear which is movable in an axial direction relative to a sun gear, so that the internal gear is disengaged from the sun gear. The abrasive disc thus becomes free to rotate, and therefore, the momentum of the abrasive disc becomes smaller when the abrasive disc is pressed on a work. U.S. Pat. No. 4,759,152 discloses an internal gear which is removable from the bottom of a body of a grinder, so that an abrasive disc becomes free to rotate as in U.S. Pat. No. 4,727,682.

In case of the grinder of U.S. Pat. No. 4,727,682, since the internal gear is moved to engage and disengage from the sun gear through its axial movement, an extra space is required in the body to permit such axial movement of the internal gear. This may result in increased height of the whole grinder, and therefore, the operability of the grinder is degraded. Further, when the internal gear is moved to engage the sun gear, the teeth of the internal gear may abut on the teeth of the sun gear in the vertical direction. Therefore, this construction has a disadvantage that the internal gear cannot smoothly engage the sun gear and that the teeth of these gears may be damaged.

In case of the grinder of U.S. Pat. No. 4,759,152, a troublesome operation is required to remove and remount the internal gear to shift grinding mode. Further, this construction has a disadvantage that the bottom of the body must have a particular structure for permitting such removal and remounting operation of the internal gear.

Additionally, with both the grinders of the above prior art U.S. patents, since the grinding disc becomes entirely free to rotate when the internal gear is disengaged from the sun gear, the grinding disc idly revolves and the revolving speed of the grinding disc reaches substantially the same rotational speed as the spindle. Thus, the grinding disc revolves at high speed, resulting in that an abrasive sheet attached to the grinding disc may be scattered and that an excellent finishing surface of a work may not be obtained when the grinding disc is applied on the work.

SUMMARY OF THE INVENTION

It is, accordingly, an object of the present invention to provide a sander in which an internal gear is not required to be axially moved to shift abrasive mode between a heavy abrasion mode and a finishing abrasion mode, so that no extra space for such movement is required and that the whole sander can be constructed to have a shorter height.

It is another object of the present invention to provide a sander which does not require a particular structure for removing an internal gear from a body, so that the sander has a simple construction.

It is a further object of the present invention to provide a sander which may not cause any undesirable interaction or damage between an internal gear and a sun gear.

It is a still further object of the present invention to provide a sander in which an abrasive disc revolves idly at a lower speed than the rotational speed of the spindle, so that an abrasive paper attached to the abrasive disc is not scattered and that a work is not damaged or is not abruptly abraded when the abrasive disc is applied on the work.

According to the present invention, there is provided a sander comprising:

a body;

a drive device mounted on the body;

a spindle rotatably driven by the drive device;

a connecting shaft mounted on the spindle and rotatable relative to the spindle around an axis displaced from the rotational axis of the spindle;

an abrasive disc fixedly mounted on the connecting shaft;

a sun gear fixedly mounted on the connecting shaft coaxially therewith;

an internal gear rotatably supported by the body and in engagement with the sun gear; and an engaging device operable to prevent and permit rotation of the internal gear relative to the body.

The invention will become more apparent from the appended claims and the description as it proceeds in connection with the drawings.

DETAILED DESCRIPTION OF THE PREFERRED EMBODIMENT

An embodiment of the present invention will now be explained with reference to the accompanying drawings.

Figure 1:
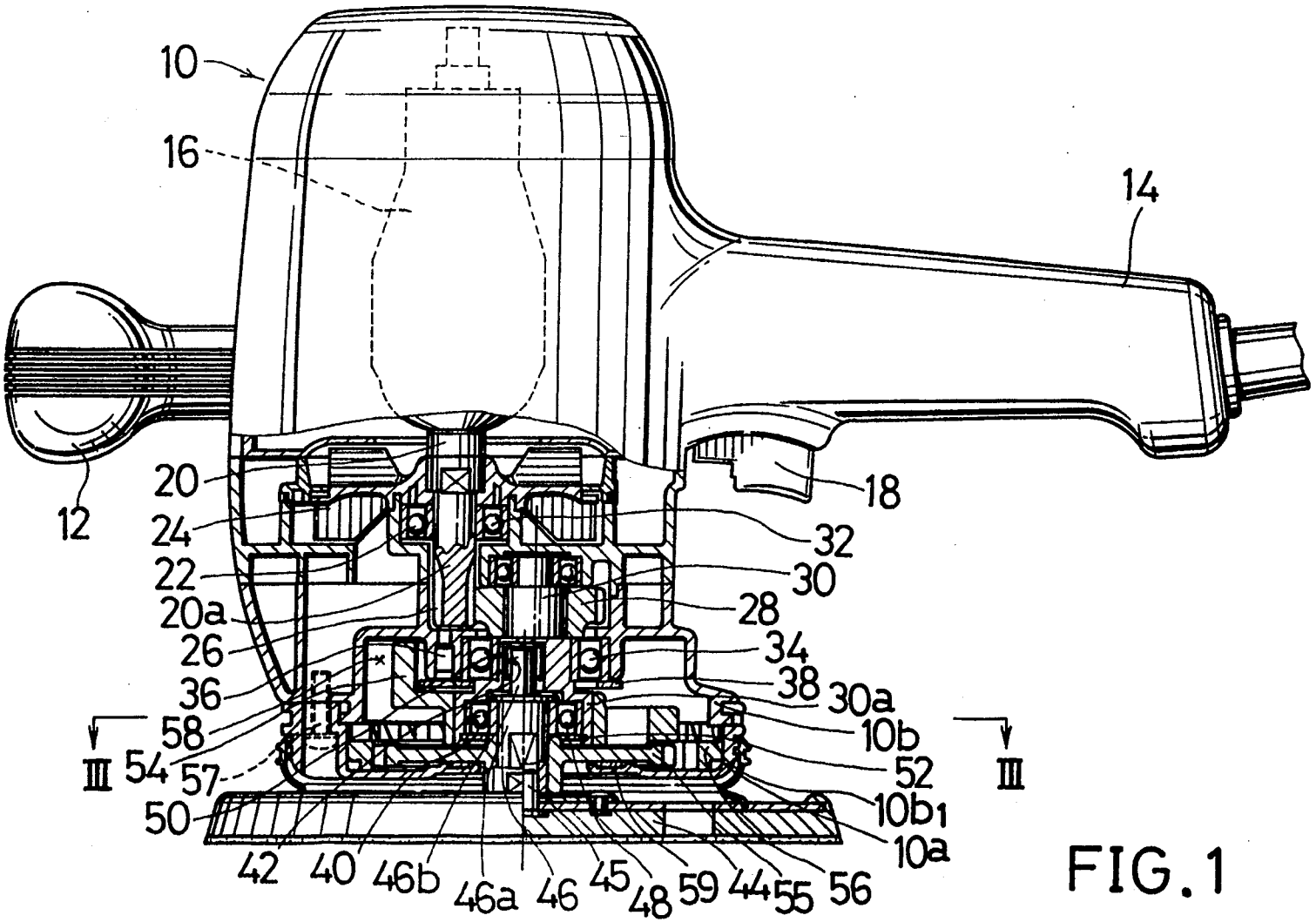
FIG. 1 is a side view, with a part broken away, of a sander according to an embodiment of the present invention.
Figure 2:
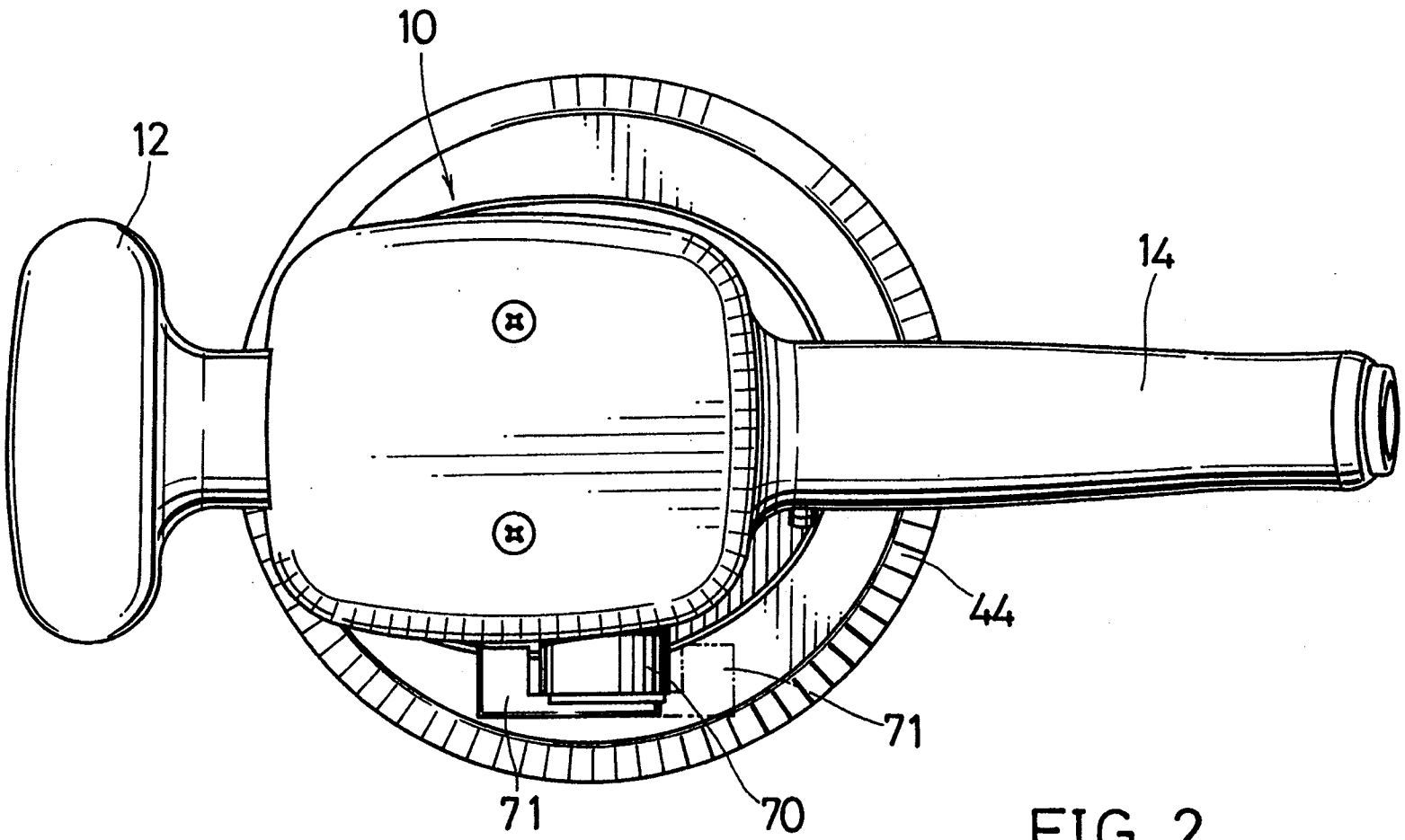
FIG. 2 is a plan view of FIG. 1.

Referring to FIGS. 1 and 2, a sander is show in vertical sectional view and plan view, respectively. The sander includes a hollow body 10 having a pressing handle 12 and a grasping handle 14. The pressing handle 12 is disposed at the forward end of the body 10 and is used to be downwardly pressed together with the body 10 by one hand of an operator. The grasping handle 14 is disposed at the rear end of the body 10 and is used to be grasped by the other hand of the operator. A motor 16 is disposed vertically within the upper central portion of the body 10. A switch 18 is mounted on the lower part of the grasping handle 14 for starting and stopping the motor 16.

A motor shaft 20 of the motor 16 is rotatably supported by the body 10 through upper and lower bearings 22 (upper one shown in the drawings). A fan 24 is mounted on the motor shaft 20 at a position above the lower bearing 22 and rotates with the motor shaft 20. The motor shaft 20 has a lower end 20*a* which extends downwardly of the lower bearing 22 and includes a gear 25 integrally formed therewith.

A spindle 30 extends vertically within the body 10 at a position rearwardly of the lower end 20*a* of the motor shaft 20. A gear 38 having a larger diameter than the gear 25 is fixedly mounted on the spindle 30 and is in engagement with the gear 25. The spindle 30 is rotatably supported by the body 10 through bearings 32 and 34 which are positioned upwardly and downwardly of the gear 38, respectively. The spindle 30 has an enlarged lower portion 30*a* at a position below the bearing 34. The lower surface of the bearing 34 is supported by a plate 38 which is fixed to the body 10 through a screw 36.

The lower portion 30*a* of the body 30 includes a first axial bore 40 having a lower end opened downwardly outwardly of the lower portion 30*a*. A second axial bore 42 is formed upwardly of the first axial bore 40 in continuous and coaxial relationship therewith. The central axis of the first and second axial bores 40 and 42 is displaced from the central axis of the spindle 30 by a predetermined distance. A connecting shaft 46 has a lower portion to which an abrasive disc 44 is fixed through a screw 45. The upper portion of the connecting shaft 3 is rotatably inserted into the first and second bores 40 and 42. More specifically, the upper portion of the connecting shaft 3 includes a larger diameter part 46*a* and a smaller diameter part 46*b* which are inserted into the first and second bores 40 and 42, respectively. Bearings 48 and 50 are interposed between the larger diameter part 46*a* and the inner surface of the first bore 40 and between the smaller diameter part 46*b* and the inner surface of the second bore 42, respectively. The lower surface of the bearing 48 of the larger diameter part 46*a* is supported by a stopper ring 52 fixedly fitted within the bore 40. A balance weight 54 is mounted on the outer surface of the lower portion 30*a* of the spindle 30 through press fitting.

Figure 3:
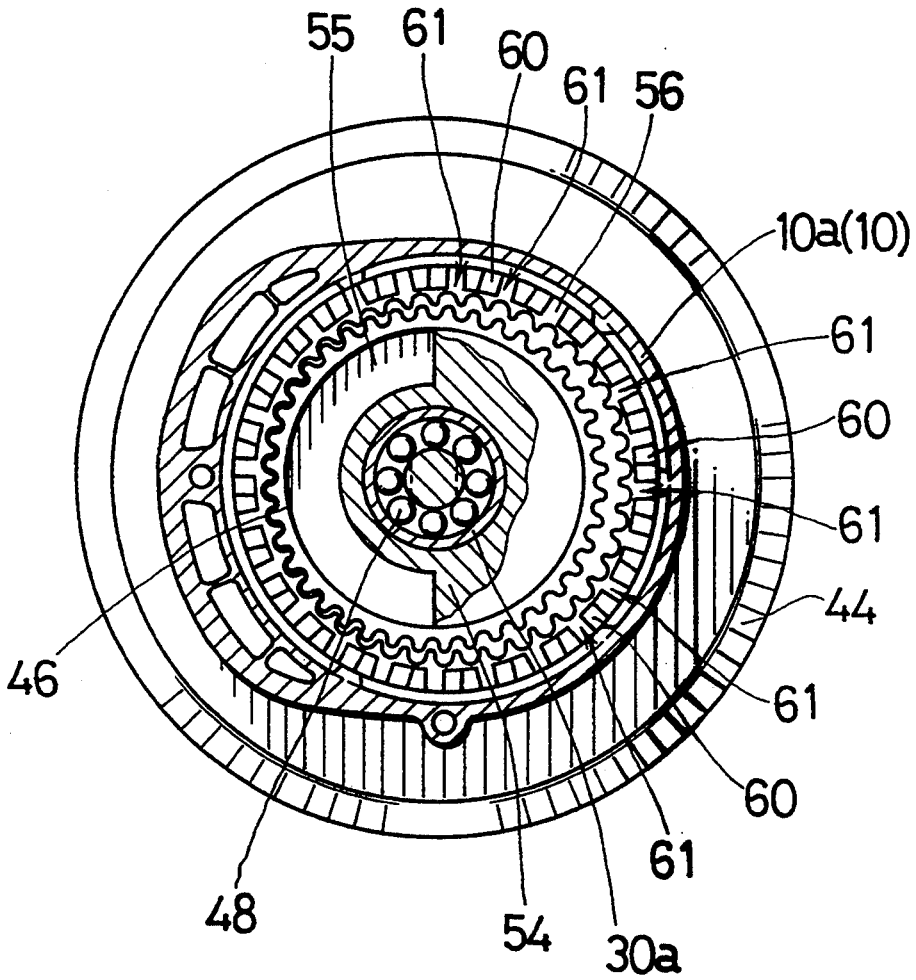
FIG. 3 is a sectional view taken along line III—III in FIG. 1.

A sun gear 55 is fixedly mounted on the larger diameter part 46*a* of the connecting shaft 46 at a position between the bearing 48 and the abrasive disc 44, so that the sun gear 55 rotates around the same axis as the connecting shaft 46. A bottom portion 10*a* of the body 10 surrounds the sun gear 55 and supports an internal gear 56 in engagement with the sun gear 55 as shown in FIG. 3. The internal gear 56 is rotatably fitted within the bottom portion 10*a* around the same axis as the spindle 30.

The bottom portion 10*a* is detachably mounted on a part 10*b* of the body 10 through a screw 57. The part 10*b* includes a support portion of the bearing 34 and has a configuration to surround the lower portion 30*a* of the spindle 30 as well as the balance weight 54 from above, so that a space 58 is formed between the part 10*b* and the bottom portion 10*a* and accommodates the lower portion 30*a* of the spindle 30, the balance weight 54, the sun gear 55 and the internal gear 56. An annular dust prevention seal 59 made of felt is interposed between the sun gear 55 and an inner bottom surface of the bottom portion 10 which is positioned below the sun gear 55 for supporting the same, so that entrance of abraded scobs of a work into the space 58 is prevented. Additionally, the part 10*b* includes an inwardly stepped portion 10*b*1 formed at a joint portion with the bottom portion 10*a* so as to prevent upward movement of the internal gear 56.

The outer peripheral surface of the internal gear 56 slidably contacts the inner peripheral surface of the bottom portion 10*a*, so that a predetermined frictional force is normally applied to the internal gear 56.

Figure 4:
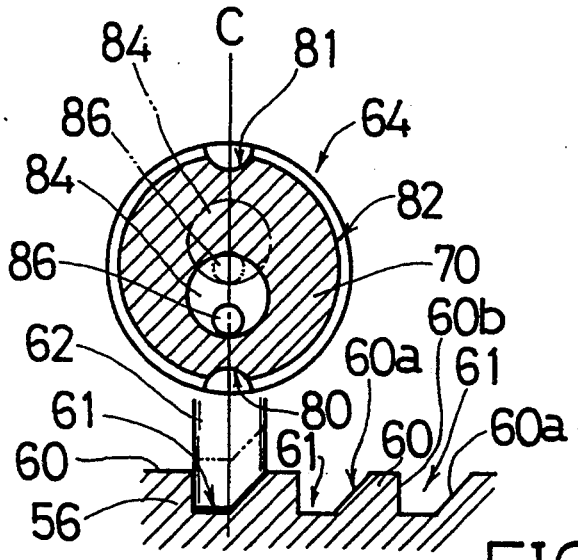
FIG. 4 is an explanatory view showing operation of an internal gear engaging mechanism.

As shown in FIG. 3, a plurality of protrusions 60 are formed on the upper surface of the internal gear 56. The protrusions 60 are equally spaced from each other in a circumferential direction, so that a recess 61 is formed between each two adjacent protrusions 60. As shown in FIG. 4, each protrusion 60 includes a slant surface 60*a* and a vertical surface 60*b* at both sides in the rotational direction of the internal gear 56 shown by an arrow in FIG. 4.

Figure 5:
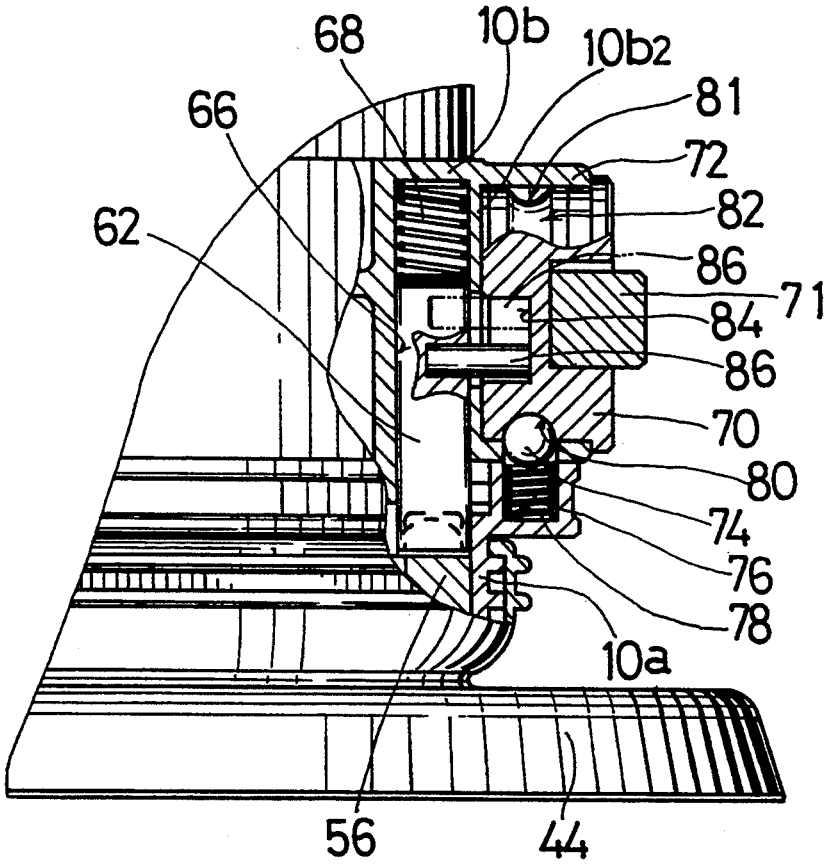
FIG. 5 is a view, with a part broken away, of a part of a body showing the mounting structure of the internal gear engaging mechanism.

An internal gear engaging mechanism 64 is disposed on the lateral side of the body 10 and includes a stopper pin 62 for engagement with any of the recesses 61. The construction of the internal gear engaging mechanism 64 will now be explained with reference to FIG. 5.

A vertical guide recess 66 is formed on the lateral portion of the bottom portion 10*a* of the body 10. The guide recess 66 has an open lower end and vertically slidably receives the stopper pin 62 which extends downwardly from the open lower end. A spring 68 is disposed within the upper portion of the guide recess 66 so as to normally bias the stopper pin 62 downwardly toward the upper surface of the internal gear 56. The lateral portion of the bottom portion 10*a* further includes a mounting portion 72 for mounting a switching knob 70 thereon. The mounting portion 72 is disposed adjacent the guide recess 60 but is separated therefrom by a partition wall 10*b*2. The switching knob 70 is received within the mounting portion 72 and is rotatable around a horizontal axis which is directed substantially toward the center of the body 10. As shown in FIG. 2, an operational handle 71 is attached to the switching knob 70 and extends radially outwardly from the switching knob 70, so that an operator can easily turn the switching knob 70 through the operational handle 71. A vertical hole 78 is formed through the bottom of the mounting portion 72 and a part of the bottom portion 10*a* disposed below the bottom of the mounting portion 72. A spring 76 is disposed within the vertical hole 78 so as to normally bias a steel ball 74 upwardly toward the peripheral portion of the switching knob 70. The peripheral portion of the switching knob 70 includes a pair of depressions 80 and 81 formed in opposed relationship with each other in a diametrical direction of the switching knob 70. Each of the depressions 80 and 81 has a substantially hemispherical configuration corresponding to the steel ball 74. An annular recess 82 having a substantially semi-circular configuration in section is formed to connect the depressions 80 and 81 to each other and has a depth smaller than that of the depressions 80 and 81.

The stopper pin 62 includes a lower end having a configuration corresponding substantially to that of each of the recesses 61 of the internal gear 56. A horizontal pin 86 is fixed to the upper portion of the stopper pin 62 and extends, through the partition wall **10*b*2, into a horizontal circular recess 84 formed on the rear surface of the switching knob 70. As shown in FIG. 4, the center of the circular recess 84 is positioned on a diametrical central line C of the switching knob 70 passing through the depressions 80 and 81 but is displaced from the center of the switching knob 70 by a predetermined distance. Here, the pin 86 normally abuts on the lowermost portion of the peripheral surface of the circular recess 84, irrespective of the rotational position of the switching knob 70, through the biasing force of the spring 68 which biases the stopper pin 62 downwardly. When the steel ball 74 is in engagement with the depression 80 disposed on the side near the circular recess 84 as shown in FIG. 4, the lower end of the stopper pin 62 engages the corresponding recess 61 of the internal gear 56 by the biasing force of the spring 68. On the other hand, when the steel ball 74 is in engagement with the depression 81 disposed on the side remote from the circular recess 84, the stopper pin 62 is disengaged from the recess 61 and is positioned upwardly of the internal gear 56**.

The operation of the above embodiment will now be explained. Firstly, the operator turns the switching knob 70 of the internal gear engaging mechanism 64, through the operational handle 71, to a position where the steel ball 74 engages the depression 80 on the side near the circular recess 84 and the switching knob 70 is kept in position. Then, the lower end of the stopper pin 62 engages the corresponding recess 61 of the internal gear 56 by the biasing force of the spring 68. When the operator starts the motor 16 through operation of the switch 18 mounted on the grasping handle 14, the rotation of the motor shaft 20 is transmitted to the spindle 30 via the gears 26 and 28. As the spindle 30 is thus rotated, the connecting shaft 46 and the abrasive disc 44 mounted on the lower portion of the connecting shaft 46 rotates around the spindle 30. Simultaneously therewith, through engagement of the sun gear 55 with the internal gear 56 which is prevented from rotation by the stopper pin 62 as described above, the abrasive disc 44 is forcibly revolved together with the connecting shaft 46 at a reduced speed. Here, the reduction ratio is normally determined to a value about 1/20. For example, if the rotational speed of the spindle 30 is 6,000 rpm, the abrasive disc 44 revolves at the rotational speed of about 300 rpm. When the operator presses the abrasive disc 44 on the work while grasping the grasping handle 14 by one hand and while downwardly pressing the pressing handle 12 by the other hand, the work is abraded by the abrasive disc 44 having a greater momentum which is produced by the combination of rotational motion around the spindle 30 and the forced revolving motion, so that a heavy abrading operation can be performed.

As the operator turns the switching knob 70 through the operation handle 71 to disengage the depression 80 from the steel ball 74, the switching knob 70 smoothly rotates with the aid of engagement of the steel ball 74 with the annular recess 82 having the depth smaller than the depression 80. When the switching knob 70 is rotated by an angle of 180°, the depression 81 disposed on the side remote from the circular recess 84 engages the steel ball 74 and the switching knob 70 is kept in position. At this stage, the stopper pin 62 is lifted through the pin 86 against the biasing force of the spring 68, so that the lower portion of the stopper pin 62 is disengaged from the corresponding recess 61 of the internal gear 56.

Thus, the internal gear 56 is permitted to be freely revolved, and therefore, the abrasive disc 44 performs a motion in combination of the rotational motion around the spindle 30 and the revolving motion around its own axis together with the internal gear 56 by the inertia force. Here, as described above, the peripheral surface of the internal gear 56 frictionally contacts the inner peripheral surface of the bottom portion **10*a* of the body 10, so that the predetermined frictional force is normally applied to the internal gear 56 against its rotation. Thus, during the idle revolution of the abrasive disc 44, the rotational speed of the internal gear 56 or the revolving speed of the abrasive disc 44 is reduced to have a value lower than the rotational speed of the spindle 30. For example, the revolving speed of the abrasive disc 44 is reduced to have a value of 300 rpm when the rotational speed of the spindle 30 is 6,000 rpm. Because of this reduced revolving speed of the abrasive disc 44, an abrasive paper which may be attached to the abrasive disc 44 may not be scattered, and the work may not be abruptly abraded or damaged when the abrasive disc 44** is applied on the work.

When the abrasive disc 44 is pressed on the work, the revolving speed of the abrasive disc 44 is further reduced through frictional force between the abrasive disc 44 and the work. Thus, the operator can perform a finishing abrading operation through the motion of the abrasive disc 44 having a smaller momentum in combination of the rotation around the spindle 30 and the reduced revolution.

When the switching knob 70 of the internal gear engaging mechanism 64 is further turned to return to the position where the depression 80 on the side near the circular recess 84 engages the steel ball 74, the stopper pin 62 is moved downwardly toward the corresponding recess 61 of the internal gear 56 by the biasing force of the spring 68. The stopper pin 62 is thus brought into engagement with the corresponding recess 61, so that the internal gear 56 is again prevented from rotation. Here, if the stopper pin 62 is not in alignment with any of the recesses 62 when it is moved, the stopper pin 62 may abut on the top surface of one of the protrusions 60. However, as the internal gear 56 is further rotated, the lower portion of the stopper pin 62 is automatically reliably brought into engagement with the recess 61 positioned adjacent the one of the protrusions 60 with the aid of the guide function of the slant surface **60*a***.

Thus, with the internal gear engaging mechanism 64 of this embodiment, even if the stopper pin 62 is abutted on the top surface of the protrusion 60 because of inappropriate timing of downward movement of the stopper pin 62, the stopper pin 62 as well as the protrusion 60 on which the stopper pin 62 abuts may not be damaged and any impact may not be applied to the switching knob 70 since such abutting force is applied through the spring 68. Further, to obtain engagement of the stopper pin 62 with the recess 61, the operator may simply turn the switching knob 70 to the position where the depression 80 engages the steel ball 74. Thus, the stopper pin 62 automatically engages the recess 61 by the biasing force of the spring 68 with the guide of the slant surface 60*a* of the protrusion 60, so that the internal gear 56 is reliably engaged.

While the invention has been described with reference to a preferred embodiment, it is to be understood that modifications or variation may be easily made without departing from the spirit of this invention which is defined by the appended claims.

What is claimed is:

1. A sander comprising:

a body;

drive means mounted on said body;

a spindle rotatably driven by said drive means;

a connecting shaft mounted on said spindle and rotatable relative to said spindle around an axis displaced from the rotational axis of said spindle;

an abrasive disc fixedly mounted on said connecting shaft;

a sun gear fixed to said connecting shaft coaxially therewith;

an internal gear rotatably supported by said body and in engagement with said sun gear; and engaging means mounted on said body and having an engaging member and an operational member operable by an operator, said engaging member being movable between a first position and a second position through operation of said operational member, said engaging member at said first position fixing said internal gear, and said engaging member at said second position permitting rotation of said internal gear.

2. The sander as defined in claim 1 wherein said engaging means includes a stopper pin for engagement with any of a plurality of recesses formed on said internal gear and disposed in a circumferential direction of said internal gear said stopper pin at said first position engages with any of said recesses; and wherein said stopper pin at said second position is disengaged from said recesses.

3. The sander as defined In claim 2 wherein said operational member includes a switching knob and wherein a detent mechanism is provided between said body and said switching knob for selectively keeping said switching knob at any of two positions corresponding to said first position and said second position of said stopper pin, respectively.

4. The sander as defined in claim 2 and further includes biasing means for normally biasing said stopper pin toward said recesses.

5. The sander as defined in claim 4 wherein each of said recesses includes a slant surface inclined upwardly toward the rotational direction of said internal gear, so that said stopper pin is automatically brought into engagement with one of said recesses by said biasing means under the guide of said slant surface.

6. The sander as defined in claim 5 wherein said stopper pin includes a lower portion having a configuration substantially corresponding to each of said recesses having said slant surface.

7. A sander comprising:

a body;

drive means mounted on said body;

a spindle rotatably driven by said drive means;

a connecting shaft mounted on said spindle and rotatable relative to said spindle around an axis displaced from the rotational axis of said spindle;

an abrasive disc fixedly mounted on said connecting shaft;

a sun gear fixed to said connecting shaft coaxially therewith;

an internal gear rotatably supported by said body and in engagement with said sun gear;

engaging means operable to prevent and permit rotation of said internal gear relative to said body; and speed reduction means to reduce the rotation of said internal gear through frictional force.

8. The sander as defined in claim 7 wherein said speed reduction means includes an inner surface of a part of said body which slidably contacts the outer peripheral surface of said internal gear.

* * * * *